US008245715B1

(12) United States Patent
Davis

(10) Patent No.: US 8,245,715 B1
(45) Date of Patent: Aug. 21, 2012

(54) PROTECTIVE GLOVE FOR HAIRSTYLIST AND A METHOD OF STRAIGHTENING HAIR

(76) Inventor: Steven D. Davis, Dallas, TX (US)

( * ) Notice: Subject to any disclaimer, the term of this patent is extended or adjusted under 35 U.S.C. 154(b) by 143 days.

(21) Appl. No.: 12/610,989

(22) Filed: Nov. 2, 2009

(51) Int. Cl.
*A45D 24/34* (2006.01)

(52) U.S. Cl. ..... 132/213.1; 132/161; 132/219; 132/207

(58) Field of Classification Search ..... 132/212–214, 132/219, 108, 161; 15/227, 104.94, 118; 119/600, 601, 611, 612, 613–617
See application file for complete search history.

(56) References Cited

U.S. PATENT DOCUMENTS

| | | | | | |
|---|---|---|---|---|---|
| 1,486,006 | A | * | 3/1924 | Blom | 132/73 |
| 2,041,262 | A | * | 5/1936 | Ness | 15/188 |
| 2,411,252 | A | * | 11/1946 | Finman | 132/149 |
| 2,467,975 | A | * | 4/1949 | Hollen | 132/149 |
| 2,568,898 | A | * | 9/1951 | Phillips et al. | 132/150 |
| 2,608,975 | A | * | 9/1952 | Shannon | 132/149 |
| 3,057,367 | A | * | 10/1962 | Langley | 132/161 |
| 3,500,477 | A | * | 3/1970 | Meszaros | 2/161.8 |
| 3,608,565 | A | * | 9/1971 | Ensign | 132/212 |
| 3,928,871 | A | * | 12/1975 | Wall | 2/161.8 |
| 3,960,155 | A | * | 6/1976 | Wall | 132/212 |
| 4,620,374 | A | | 11/1986 | Patterson | |
| 4,751,747 | A | * | 6/1988 | Banks et al. | 2/21 |
| 4,766,914 | A | | 8/1988 | Briggs | |
| 5,564,154 | A | * | 10/1996 | Cohn, III | 15/227 |
| 5,720,048 | A | * | 2/1998 | Perez | 2/161.6 |
| 6,189,150 | B1 | * | 2/2001 | Jones-Roberson | 2/163 |
| 6,206,010 | B1 | * | 3/2001 | Malki | 132/161 |
| 6,260,203 | B1 | * | 7/2001 | Battle | 2/161.6 |
| D524,489 | S | * | 7/2006 | Scott | D29/113 |
| 7,346,955 | B2 | * | 3/2008 | De Laforcade | 15/227 |
| 7,401,612 | B2 | | 7/2008 | De Laforcade | |
| 2003/0079273 | A1 | | 5/2003 | Genkins | |
| 2004/0182408 | A1 | | 9/2004 | De LaForcade | |
| 2004/0187182 | A1 | | 9/2004 | Carraway | |
| 2004/0261810 | A1 | * | 12/2004 | Gifford | 132/200 |
| 2006/0048259 | A1 | | 3/2006 | Keppler et al. | |
| 2006/0090771 | A1 | * | 5/2006 | Ramet | 132/200 |
| 2006/0218696 | A1 | | 10/2006 | Billups | |
| 2006/0230487 | A1 | | 10/2006 | Salomon | |
| 2006/0253952 | A1 | | 11/2006 | Caudillo | |
| 2006/0272116 | A1 | * | 12/2006 | Thompson | 15/227 |
| 2007/0226874 | A1 | * | 10/2007 | Cain | 2/159 |
| 2008/0313788 | A1 | * | 12/2008 | Yan | 2/158 |
| 2009/0145452 | A1 | * | 6/2009 | Anderson et al. | 132/202 |

OTHER PUBLICATIONS http://www.hai-elite.com/NEWHAIELITE/gloves.html.
http://shop.ginalli.com/main.sc.
http://www.maxiusbeauty.com/Tools.aspx.

* cited by examiner

*Primary Examiner* — Todd Manahan
*Assistant Examiner* — Tatiana Nobrega

(57) ABSTRACT

A protective glove and a method of straightening hair are disclosed. In one embodiment, the protective glove includes: (1) a first finger and a second finger for adjacent fingers of a hand, (2) a thermal shield located at least along an inner section of the first and second fingers and (3) a combing system including comb teeth located along the inner section of the first finger.

19 Claims, 4 Drawing Sheets

PROTECTIVE GLOVE FOR HAIRSTYLIST AND A METHOD OF STRAIGHTENING HAIR

TECHNICAL FIELD

This application is directed, in general, to a hairstylist glove and, more specifically, to a glove for protecting a hairstylist's hand from heated hair.

BACKGROUND

Hair stylists provide many services to their customers including cutting, coloring and styling. Often while styling, a client's hair can become hot due to the use of styling tools, such as, blow dryers and hair irons including flat irons and curling irons. Additionally, straightening a customer's hair may also be provided. There are several different straightening processes that may be used to provide varying degrees of semi-permanent or permanent straight hair for a client. Japanese hair straightening or Brazilian hair straightening are examples of different processes that may be used to straighten a client's hair. Typically, each of these straightening processes includes applying chemicals to the hair and using a flat iron on the hair. A hairstylist may use the flat iron for multiple hours on a client's hair during the straightening process. As such, a client's hair can become sufficiently heated to burn the hands or hand of the hairstylist.

SUMMARY

One aspect provides a protective glove. In one embodiment, the protective glove includes: (1) a first finger and a second finger for adjacent fingers of a hand, (2) a thermal shield located at least along an inner section of the first and second fingers and (3) a combing system including comb teeth located along the inner section of the first finger.

In another aspect, a method of straightening hair is provided. In one embodiment, the method includes: (1) applying a chemical to hair, the chemical configured to assist in straightening the hair and (2) ironing the hair employing a hair iron and a protective glove, the glove having a first finger and a second finger for adjacent fingers of a hand, a thermal shield located at least along an inner section of the first and second fingers and a combing system located along the inner section of the first finger.

In yet another embodiment, another embodiment of a protective glove is disclosed. In this embodiment, the protective glove includes: (1) a first finger and a second finger for adjacent fingers of a hand, (3) a thermal shield located at least along an inner section of both the first and second fingers and a web therebetween and (3) a combing system located along at least one of the inner sections of the first and second fingers.

BRIEF DESCRIPTION

Reference is now made to the following descriptions taken in conjunction with the accompanying drawings, in which.

DETAILED DESCRIPTION

The present disclosure provides embodiments of a glove that protects a user's (e.g., a hairstylist's) hand from heated hair (i.e., a burn from heat). Additionally, the disclosed glove includes a combing system that allows the glove to be used as a comb. Thus, a stylist can use the glove to work with a client's hair that has been heated by a styling tool, such as, a flat iron. The glove may also protect a hairstylist's hand from chemicals that are used on a client's hair, such as during a hair straightening process.

The disclosed glove may be configured to be worn on either hand and configured to protect two different fingers of a hand. In other words, in some embodiments the same glove may be constructed such that the hairstylist can use the glove to protect, for example, the index and middle finger or the middle finger and the ring finger. In some embodiments, greater than two fingers may be protected from heated hair or chemically treated hair. For example, all of the fingers including the thumb may be protected.

Figure 1:
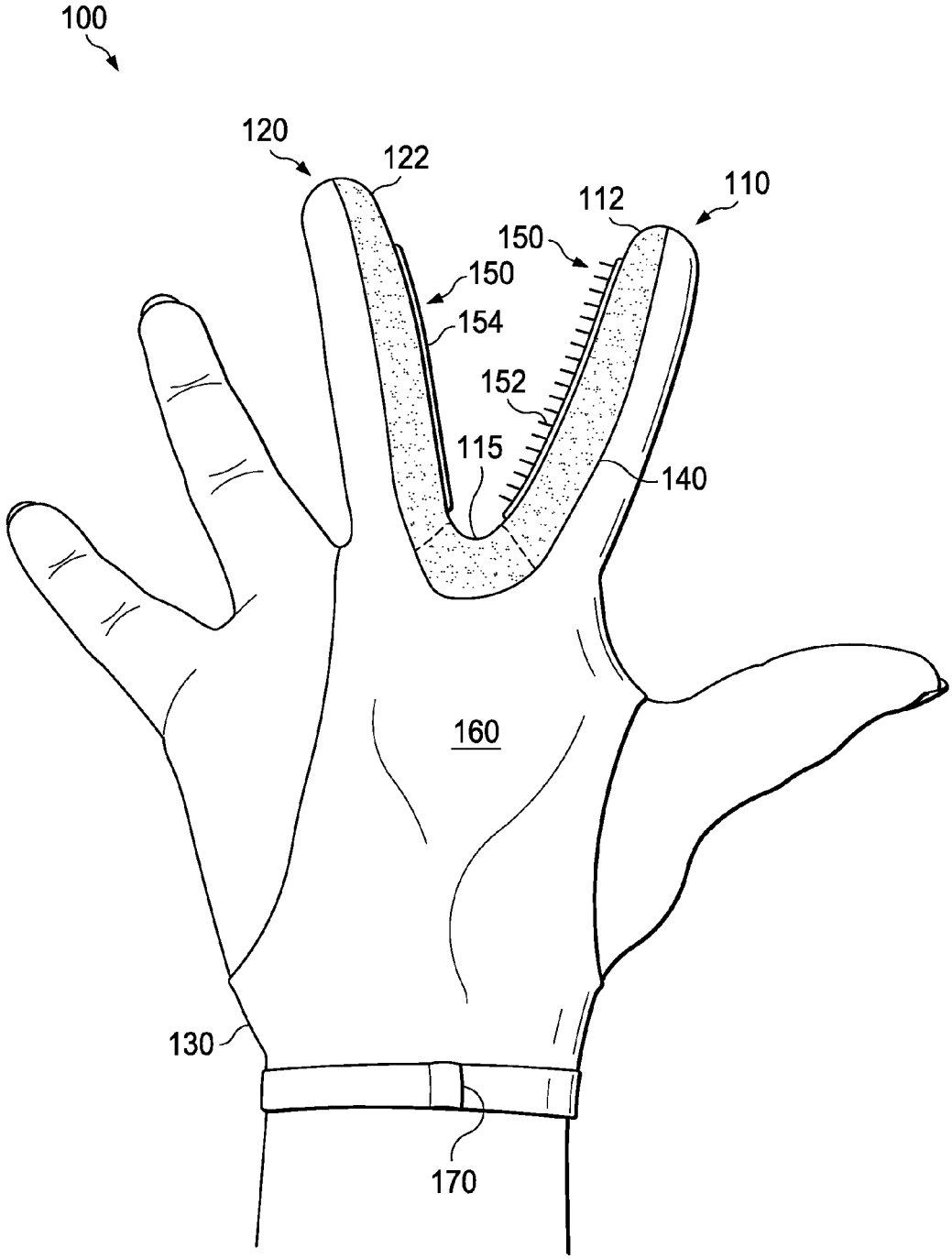
FIG. 1 illustrates a diagram of an embodiment of a protective glove constructed according to the principles of the disclosure.

FIG. 1 is a diagram of an embodiment of a protective glove 100 constructed according to the principles of the present disclosure. In FIG. 1, the protective glove 100 is presented on a right hand. The protective glove 100, however, may also be worn on a left hand. As such, the protective glove 100 may not be hand-specific but can be worn on either a right hand or a left hand. Additionally, fingers of the protective glove 100 may not be finger-specific but can be worn on different fingers.

The protective glove 100 may be constructed of conventional materials that are used for various types of gloves. Multiple types of materials may be used. Portions of the protective glove 100 may include a chemical resistant material that is configured to provide protection against chemicals used on a client's hair. The protective glove 100 may include multiple layers of material. For example, the protective glove 100 may include an inner layer, such as for padding, and an outer layer, such as for chemical protection. Additionally, a third layer, a thermal shield 140 may provide protection against heated hair.

The protective glove 100 includes a first finger 110, a second finger 120, a wrist portion 130, the thermal shield 140 and a combing system 150. A palm portion 160 and a back portion (not visible in FIG. 1) are also included.

As illustrated, the protective glove 100 is configured to fit on a hand. The first finger 110 and the second finger 120 are constructed to fit over fingers of the hand of, for example, a hairstylist. In the illustrated embodiment, the first finger 110 fits over an index finger of the hand and the second finger 120 fits over a middle finger of the hand. The first and second fingers 110, 120, however, may be used on different fingers of the hand.

The wrist portion 130 provides an opening to place the protective glove 100 on the hand. In FIG. 1, the protective glove 100 includes a fastener 170 located at the wrist portion 130. The fastener 170 may include Velcro, a snap, a zipper, a button or other type of fastening devices that may be used to secure a glove on a hand. In some embodiments, the protective glove 100 may not include a fastener 170. As such, the shape thereof, for example, may be relied upon to keep the protective glove 100 on the hand. Additionally, in some embodiments, the fastener 170 may be located at a different location on the protective glove 100. In some embodiments, the fastener 170 may be located at the palm portion 160 or the back portion of the protective glove 100.

The thermal shield 140 is configured to protect the hand from heat while working with hair. For example, during a straightening process, the hair can become sufficiently hot due to flat ironing to burn the skin of a hairstylist's hand. Accordingly, the thermal shield 140 is located along an inner section of both the first and second fingers 112, 122, respectively. Additionally, the thermal shield 140 may be located along the web 115 between the first and second fingers 110, 120, as illustrated in FIG. 1. In some embodiments, the thermal shield 140 may not be located in the web 115 (denoted by the dashed lines in FIG. 1). The thermal shield 140 may be constructed of a conventional heat-resistant material that is used with gloves. For example, the thermal shield 140 may be constructed of an aramid fabric.

The thermal shield 140 may be disposed on the first and second fingers 110, 120. The thermal shield may be attached via a conventional means such as a glue or thread. In some embodiments, the thermal shield 140 may form part of the first and second fingers 110, 120, instead of being disposed thereon.

The combing system 150 is also located along the inner sections 112, 122, of the first and second fingers 110, 120. The combing system 150 includes teeth 152 located along the inner section of the first finger 110. The combing system 150 also includes a corresponding receiver 154 for the comb teeth 152 that is located along the inner section of the second finger 120. The corresponding receiver 154 is configured to receive the comb teeth 152. In one embodiment, the corresponding receiver 154 may include a series of openings or holes that correspond to the comb teeth 152 and allow penetration of the comb teeth 152 when the inner sections of the first and second fingers 110, 120, are closed together. In another embodiment, the corresponding receiver 154 may include one or more openings that are each configured to receive multiple of the comb teeth 152. The comb teeth 152 may be constructed of a type of plastic or another material typical used for combs. The corresponding receiver 154 or at least a portion thereof may also be constructed of a type of plastic.

Figure 4:
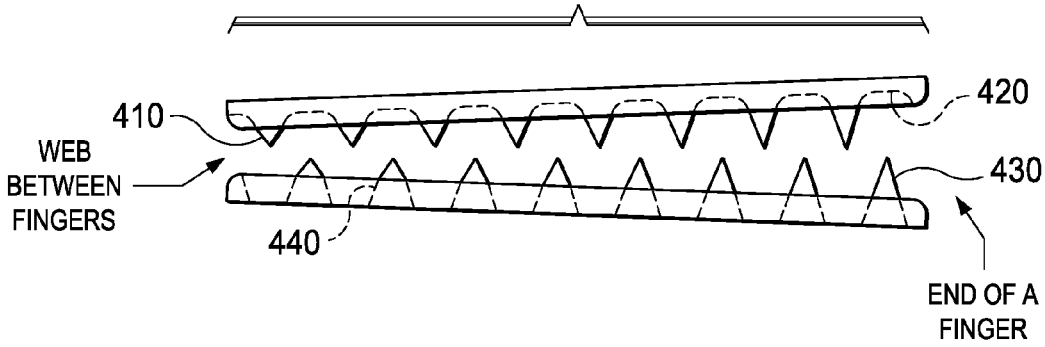
FIG. 4 illustrates a side view of an embodiment of a combing system constructed according to the principles of the disclosure.

The comb teeth 152 may be arranged in a single row or in multiple rows. The spacing between each tooth may vary within each combing system 150 and/or within each row. In some embodiments, the combing system 150 may include additional comb teeth on the inner section of the second finger 120. These additional comb teeth (not illustrated in FIG. 1) may be spaced to interleave with the comb teeth 152 when the inner sections of the first and second fingers 110, 120, are closed together. As such, the inner sections of the first and second fingers 110, 120, may be closed together and used to comb the hair. In some embodiments, the combing system 150 may include corresponding receivers and comb teeth interleaved along each of the inner sections of the first and second fingers 110, 120. Various embodiments of combing system employable with the protective gloves disclosed herein are illustrated in FIG. 4.

Figure 2:
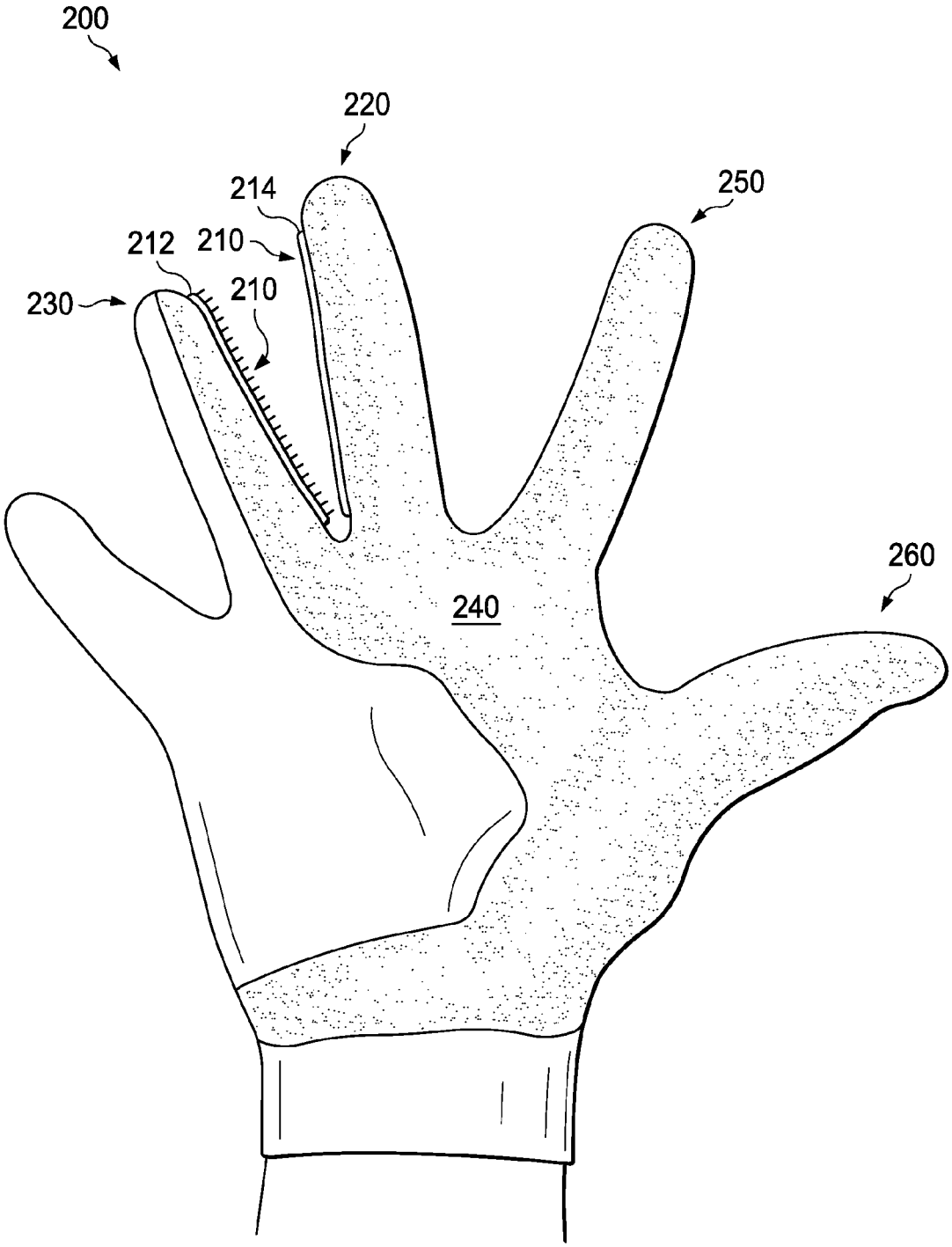
FIG. 2 illustrates a diagram of another embodiment of a protective glove constructed according to the principles of the disclosure.

FIG. 2 illustrates a diagram of another embodiment of a protective glove 200 constructed according to the principles of the disclosure. The protective glove 200 is constructed to protect hands of a user from heated hair. Additionally, the protective glove 200 may protect a user's hands from chemicals used on hair. The protective glove 200 may be constructed of similar material as the protective glove 100. Unlike the protective glove 100, the protective glove 200 includes a combing system 210 between a first finger 220 and a second finger 230.

The combing system 210 includes comb teeth 212 and a corresponding receiver 214 for the comb teeth 212. In FIG. 2, the comb teeth are located on the inner section of the second finger 230 and the corresponding receiver 214 is located along the inner section of the first finger 220. One skilled in the art will understand the location of the comb teeth 212 and the corresponding receiver 214 may be switched.

As in FIG. 1, the protective glove 200 also includes a thermal shield, thermal shield 240. The thermal shield 240 is configured to protect the hand while touching hot hair. The thermal shield 240 is located along an inner section of both the first and second fingers 220, 230, respectively. Additionally, the thermal shield 240 is located along the web between the first and second fingers 220, 230, as illustrated in FIG. 2. For the protective glove 200, the thermal shield 240 also covers the remaining portion of the first finger 220, a third finger 250 and a thumb 260. The base of the first and third fingers 220, 250, the base of the thumb 260 and the base of the hand portion of the protective glove 200 are also protected by the thermal shield 240. Thus, the protective glove 200 is configured to cover an entire hand and the thermal shield 240 is located to protect particular areas of a hand. For example, to protect a user's hand from hot hair while using the protective glove 200 with a flat iron.

Figure 3:
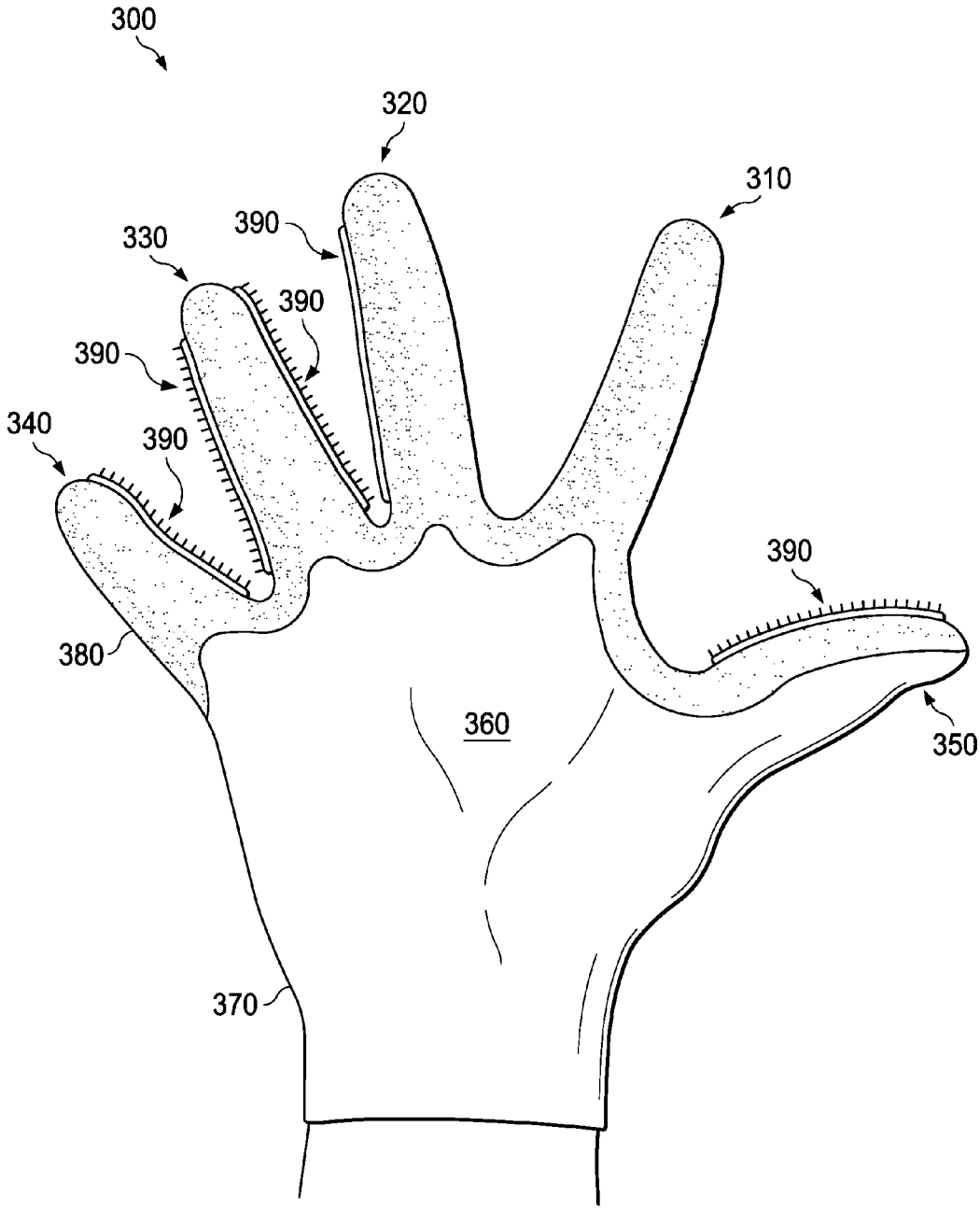
FIG. 3 illustrates a diagram of yet another embodiment of a protective glove constructed according to the principles of the disclosure.

FIG. 3 illustrates another embodiment of a protective glove 300 constructed according to the principles of the disclosure. The protective glove 300 is also constructed to protect a user, such as a hairstylist, from burns due to heated hair. For instance, the hair may be hot due to a straightening process. The protective glove 300 may be constructed of similar materials as the protective glove 100 and include similar portions. The protective glove 300, however, is provided to demonstrate a protective glove constructed according to the principles of this disclosure may include additional fingers (including the thumb), that include a thermal shield and part of a combing system. The protective glove 300, therefore, can provide heat protection and a combing system for more than just two fingers of a hand.

The protective glove 300 includes a first finger 310, a second finger 320, a third finger 330, a fourth finger 340 and a thumb portion 350. In FIG. 3, the first through fourth fingers 310, 320, 330, 340, of the protective glove 300 cover the index finger, the middle finger, the ring finger and the pinkie, respectively, of a left hand. Additionally, the protective glove 300 includes a palm portion 360, a back portion (not visible from FIG. 3) and a wrist portion 370 are included. The protective glove 300 does not include a fastener.

As illustrated, the thermal shield 380 may be located between each of the inner sections of the fingers 310, 320, 330, 340, and the thumb portion 350. Additionally, thermal shields 380 may also be located at various locations of the protective glove 300 such as the outer side of the fourth finger 340. In some embodiments, the protective glove 300 may include a thermal shield over a majority of the surface area thereof. In some embodiments, the protective glove 300 may be constructed of multiple layers including a chemical resistant layer and a thermal shield layer.

The protective glove 300 may also include a combing system 390 that is in more locations than just between two adjacent fingers. As illustrated, parts of the combing system 390 may be located on the inner sections of the second and third fingers 320, 330, and the thumb 350. In FIG. 3, the third finger 330 includes part of the combing system 390 on each inner section. In FIG. 3, the combing system 390 includes a corresponding receiver on the second finger for the comb teeth located on the third finger 330. The combing system 390, however, may also include comb teeth without corresponding receivers as illustrated with the thumb 350.

FIG. 4 illustrates a side view of an embodiment of a combing system 400 constructed according to the principles of the disclosure. The combing system 400 includes a first set of comb teeth 410, a first set of corresponding receivers 420, a second set of comb teeth 430 and a second set of corresponding receivers 440. The first set of comb teeth 410 and the first set of corresponding receivers 420 are located on a first finger of a protective glove, such as the protective glove 100 or the protective glove 200. The second set of comb teeth 430 and the second set of corresponding receivers 440 are located on a second finger, adjacent to the first finger, of the protective glove. The first set of comb teeth 410 corresponds to the second set of corresponding receivers and the second set of comb teeth 430 corresponds to the first set of corresponding receivers 420. The first and second set of comb teeth 410, 430, may be attached to a thermal shield of the protective glove. The first and second set of corresponding receivers 420, 440, may also be attached to the thermal shield. The corresponding receivers 420, 440, have a sufficient depth to receive at least a portion of the corresponding comb teeth.

As illustrated in FIG. 4, the length of the comb teeth may vary along the combing system 400. As illustrated, the length of the comb teeth may increase based on the distance from the web between two fingers or the distance from the end of a finger. As such, the longer comb teeth would be located at the end of each finger. This can improve combing of hair by compensating for the difference in distance between adjacent fingers at the web of the fingers compared to the ends of the fingers when the inner sections of adjacent fingers are being closed together. Thus, the length of the comb teeth may be based on the location of a comb tooth (i.e., distance) from the web between the adjacent fingers or, similarly, the distance from the location of a comb tooth with respect to the end of a finger. Corresponding receivers may also have different depths to with respect to the comb teeth.

Figure 5:
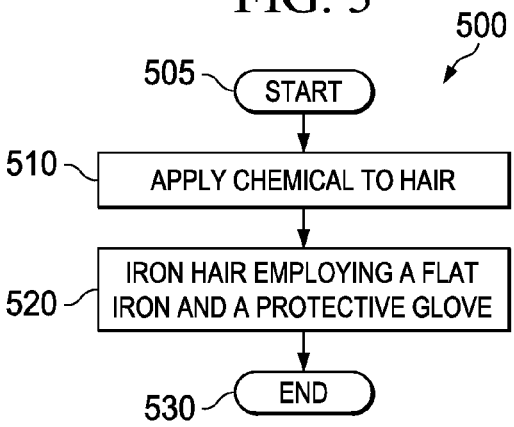
FIG. 5 illustrates a flow diagram of an embodiment of a method of straightening hair carried out according to the principles of the disclosure.

FIG. 5 illustrates an embodiment of a method 500 of straightening hair carried out according to the principles of the disclosure. The method 500 includes employing a protective glove. The protective glove includes at least a first finger and a second finger for adjacent fingers of a hand, a thermal shield located at least along an inner section of the first and second fingers and a combing system located along the inner sections of the first and second fingers.

The method may begin in a step 505. In a step 510, a chemical is applied to hair. The chemical or chemicals may be conventional products that are used to assist in permanently or semi-permanently straightening human hair. The chemical or chemicals may be applied in multiple steps.

In a step 520, the hair is then ironed employing a flat iron and a protective glove. Typically, the protective glove is worn on the opposite hand operating the hair iron. The protective glove may be used to protect the hairstylist from burns due to the heated hair. Additionally, the protective glove may be used to comb the hair during the hair ironing process. The process 500 ends in a step 530.

Those skilled in the art to which this application relates will appreciate that other and further additions, deletions, substitutions and modifications may be made to the described embodiments. Additionally, the hairstylists and clients referred to in this application are not restricted to professional hairstylists and paying clients.

What is claimed is:

1. A protective glove, comprising:

a first finger and a second finger for adjacent fingers of a hand;

a web portion between said first finger and said second finger;

a thermal shield constructed of a heat resistant material located at least along an inner section between said first and second fingers; and a combing system including comb teeth located along said inner section of said first finger, said comb teeth increase in length based on a distance of said comb teeth from said web portion.

2. The protective glove as recited in claim 1 wherein said combing system further includes a corresponding receiver, for said comb teeth, located along said inner section of second finger.

3. The protective glove as recited in claim 1 wherein said protective glove is constructed of a chemical resistant material.

4. The protective glove as recited in claim 1 wherein said first finger is for an index finger of said hand and said second finger is for a middle finger of said hand.

5. The protective glove as recited in claim 1 wherein said protective glove is wearable on for both a right hand and a left hand.

6. The protective glove as recited in claim 1 wherein said thermal shield is located in said web portion.

7. The protective glove as recited in claim 1 further comprising a fastener for securing said protective glove on said hand.

8. The protective glove as recited in claim 1 wherein said comb teeth are arranged in at least one row.

9. The protective glove as recited in claim 2 wherein said corresponding receiver has sufficient depth to receive said comb teeth.

10. The protective glove as recited in claim 1 further comprising a thermal shield along an outer section of said first or second fingers.

11. The protective glove as recited in claim 1 further comprising a third finger.

12. The protective glove as recited in claim 11 further comprising a fourth finger.

13. The protective glove as recited in claim 12 further comprising a thumb portion.

14. The protective glove as recited in claim 13 wherein said thermal shield is located at multiple fingers of said protective glove.

15. The protective glove as recited in claim 14 wherein said combing system further includes additional comb teeth located on an inner section of said third, said fourth or said thumb portion.

16. The protective glove as recited in claim 1 wherein said combing system further includes additional comb teeth located along said inner section of said second finger.

17. The protective glove as recited in claim 1 wherein said combing system further includes a corresponding receiver located on said inner section of said first finger.

18. A protective glove, comprising:

a first finger and a second finger for adjacent fingers of a hand; a web portion between said first finger and said second finger;

a thermal shield constructed of a heat resistant material located at least along an inner section between both said first and second fingers and said web portion; and a combing system located along at least one of said inner sections of said first and second fingers, said combing system including comb teeth wherein said comb teeth increase in length based on a distance of said comb teeth from said web portion, said comb teeth having a longer length are positioned a further distance from said web portion than said comb teeth having a shorter length.

19. The protective glove as recited in claim 1, wherein said inner section substantially extends along a length of said first finger from the web between said first finger and said second finger to the end of said first finger, and said comb teeth are substantially located along said inner section.

* * * * *